United States Patent [19]

Strohmeyer, Jr.

[11] 4,442,795

[45] Apr. 17, 1984

[54] RECIRCULATING FLUIDIZED BED COMBUSTION SYSTEM FOR A STEAM GENERATOR

[75] Inventor: Charles Strohmeyer, Jr., Gladwyne, Pa.

[73] Assignee: Electrodyne Research Corporation, Gladwyne, Pa.

[21] Appl. No.: 448,028

[22] Filed: Dec. 8, 1982

Related U.S. Application Data

[63] Continuation-in-part of Ser. No. 371,528, Apr. 26, 1982.

[51] Int. Cl.[3] ..... F22B 1/00

[52] U.S. Cl. ..... 122/4 D; 110/245; 110/263; 431/170

[58] Field of Search ..... 122/4 D; 110/245, 263; 431/7, 170; 165/104.16

[56] References Cited

U.S. PATENT DOCUMENTS 4,085,707 4/1978 Moss ..... 122/4 D
4,165,717 8/1979 Reh et al. ..... 431/7
4,250,839 2/1981 Daman ..... 122/4 D
4,312,301 1/1982 Anson ..... 110/263

FOREIGN PATENT DOCUMENTS 56-68708 6/1981 Japan ..... 431/7

*Primary Examiner*—Edward G. Favors
*Assistant Examiner*—Steven E. Warner
*Attorney, Agent, or Firm*—William J. Ruano

[57] ABSTRACT

The invention comprises a steam generator fluidized bed which recirculates through a major portion of the normal gas to fluid heat transfer circuits. Solid bed material is separated, collected and recirculated. Bed temperatures are limited by regulation of density of bed inert material to inhibit the radiant aspects of combustion. Gas recirculation is used to supplement air flow to achieve higher than entrainment bed gas velocity in the fuel ignition and reaction zone. Fuel ignition and reaction are controlled by limiting the amount of atmospheric air flow to the circulating fuel rich bed mixture to regulate extent of propagation of the ignition and reaction zone into the initial portion of the circulating bed loop, starting from the point of highest gas pressure.

8 Claims, 2 Drawing Figures

RECIRCULATING FLUIDIZED BED COMBUSTION SYSTEM FOR A STEAM GENERATOR

Figure 1:
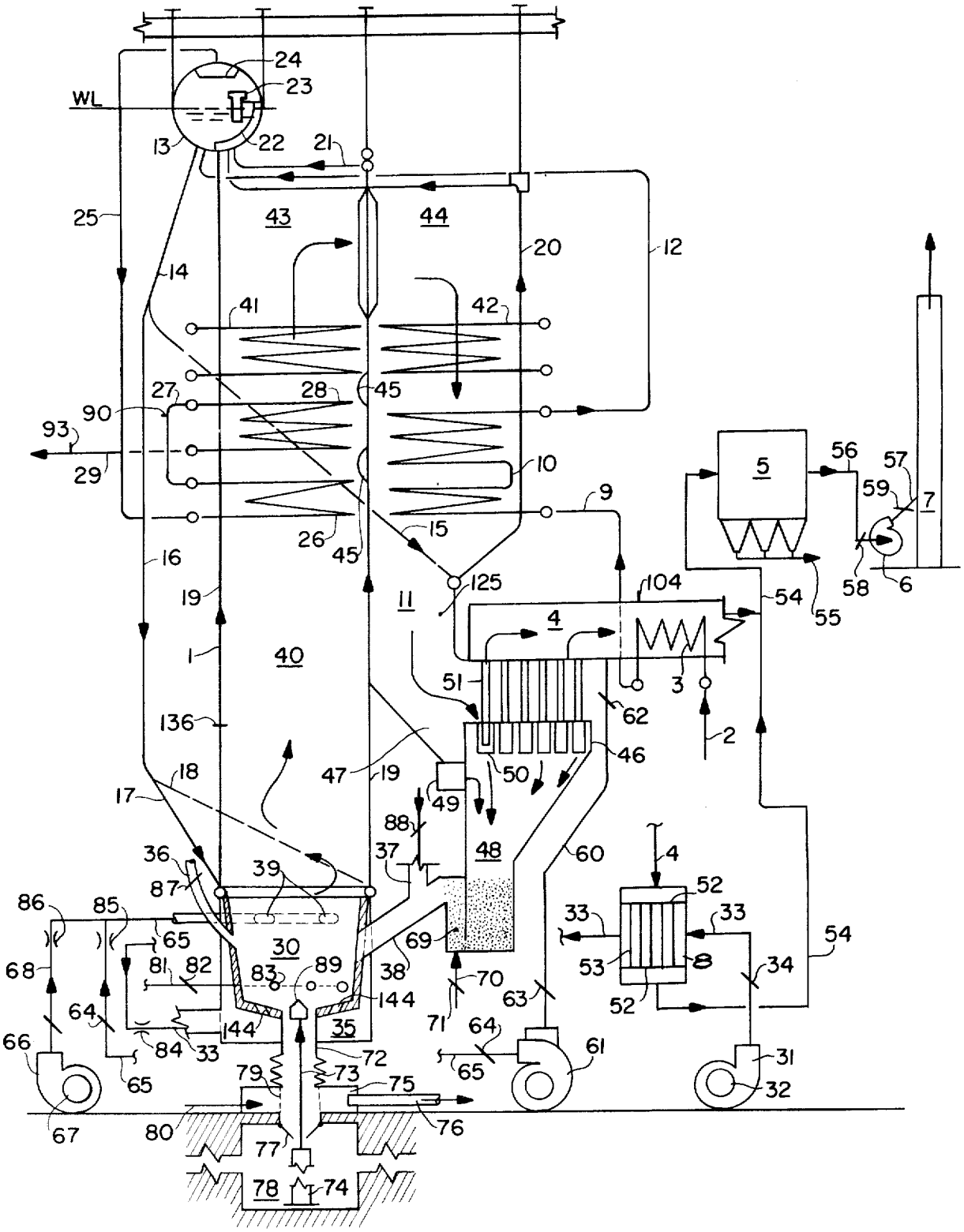

This invention is a continuation-in-part to U.S. Pat. Application Ser. No. 06/371,528 filed 4/26/82

This invention relates to means for improving the performance of steam generators provided with combustion means for firing fossil fuels. The combustion system comprises a circulating fluidized bed loop wherein fuel is injected into the upstream end and entrainment gas velocities are exceeded for at least a significant portion of the bed solid particles so as to extend bed penetration up through a tall stack type furnace and heat exchange surface disposed at the top. The loop then overflows downward through heat exchange surface to a separator where solid bed particles are collected and recirculated to the high pressure end of the loop.

Some separation by gravity means may occur between the stack type furnace and down flow heat exchanger zone.

According to U.S. Pat. Application Ser. No. 06/371,528 filed 4/26/82 there is gas recirculation means provided for bed fluidizing purposes.

Past fluidized bed combustors have mainly been of the fixed bed type wherein the bed depth has been relatively shallow and the bed has been operated at a uniform temperature. Such a configuration leads to a requirement for a large horizontal cross section area for heat release purposes and inclusion of heat absorption surface immersed within the shallow bed for improvement of high temperature heat transfer capability. This restricts size of the unit. Uniform distribution of air and fuel throughout the bed becomes a problem. This in turn limits turndown capability of the firing system and can create operating problems.

One of the objectives of the fixed bed design is to limit carry over or the escape of particles from the bed before they have adaquately reacted within the bed (ie: with limestone for removal of $SO_2$). Separators have been installed to collect particulate carry over and where such particulate was high in unburned carbon it was recirculated to the bed. The bed cannot be considered to be of a recirculation type as there is a sharp demarcation between the bed and downstream gas path.

In the case where a fixed bed is equipped with an overfeed system supplying fuel to the top of the bed, fines can ignite before reaching the bed and create an overbed firing situation wherein the convective and limestone reactive aspects of the fluidized bed process are deteriorated.

A circulating fluidized bed of Finnish origin is being marketed. Such design has a large cyclone built into the circuit at the furnace outlet where the bed solids are collected and recirculated to the high pressure loop inlet through a loop type seal. The loop temperature is held essentially constant and some small rise in temperature can be expected across the cyclone. Separation is a result of mechanical centrifugal action rather than from gravity means. Recirculation is limited to the furnace portion of the overall steam generator circuit. Some platen superheater surface has been installed at the top of the furnace. The furnace and cyclones are supported independently of the convection pass at the outlet of the separator. Reduction of gas temperature is accomplished after the separator.

The cyclone configuration at the furnace outlet limits the size of furnace which can be employed as well as overall steam generator which can be constructed.

The present invention overcomes past difficulties in that a larger furnace volume can be utilized along with overall economy which results from a tower inverted U type boiler configuration top supported. Less ground space is required for the installation.

Fuel ignition takes place in the more dense high pressure end of the gas and solids circulation loop under agitated conditions to assure thorough mixing of fuel and additives (as limestone) within the bed.

Entrainment velocities are dependent upon density, size and shape of the material. The larger, more dense particles settle to the bottom constricting the cross section area increasing gas velocities to the point where suspension occurs. Only a portion of the bed recirculates at any one point in time and recirculation rates for the respective particle classifications vary The density of the particles in the upflow furnace column decreases as height increases to the point where there is spillover to the downflow column connecting to the separator/collector. An initial gravity separation of solids materials may occur as described below.

Fuel ignition and reaction within the recirculation loop is controlled by air and gas recirculation flows to limit the depth of penetration through the loop for bed temperature control, heat absorption balancing purposes and for regulation of gas temperature decay at the outlet end of the recirculating loop.

For the steam generator described herein, a specific object of this invention is to provide a means for control of penetration of the fuel ignition and reaction zone into the downstream portion of the fluidized bed recirculation loop starting from the high pressure location.

A further object is to maintain the initial portion of the fluidized bed recirculation loop (ignition and reaction zone) at essentially constant temperature and passing the end portion of the circulating loop over heat transfer surface to cool the gas temperature.

A still further object is to supplement air flow to the circulating fluidized bed combustor with gas recirculation flow to create and sustain solid particle entrainment gas velocities within the bed.

A still further object is to bias ignition/reaction penetration and solid particle entrainment gas velocity through control of atmospheric air and gas recirculation mass flows.

A still further object is to provide a means of separation of the circulating bed solid materials from the gas stream by gravity.

A still further object is to provide a unitized fluidized bed combustor, furnace and convection pass heat exchange apparatus to cool the hot combustion gas progressively all of which can be top supported.

A still further object is to provide means for removal of debris from the base of the fluidized bed.

Figure 2:
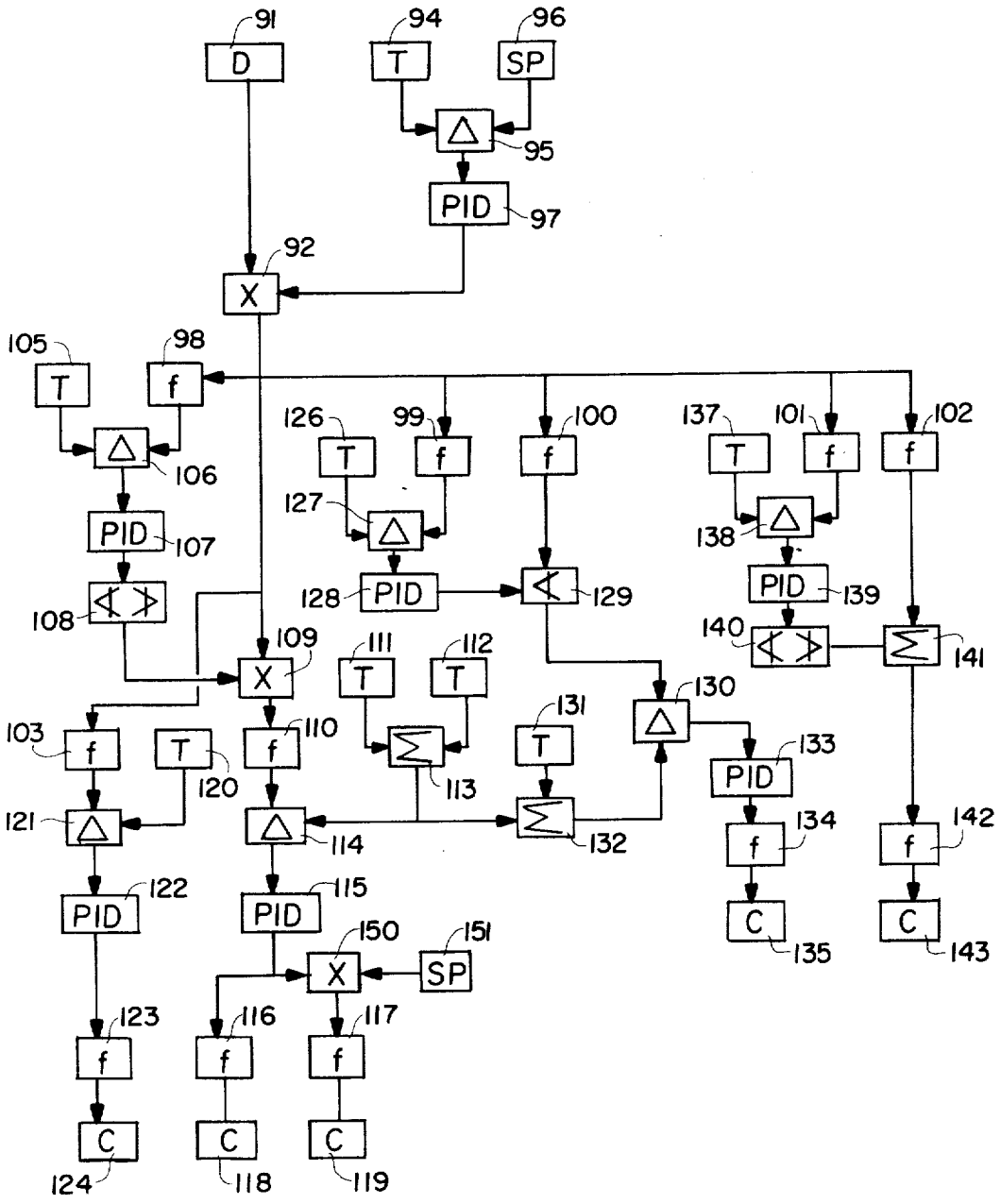

The invention will be described in detail with reference to the accompanying drawings wherein:

FIG. 1 is a schematic diagram of a steam generator having a circulating type fluidized bed combustion system in accordance with the objectives of this invention, and FIG. 2 is a schematic diagram of the control system.

The invention is illustrated in FIG. 1 which is a side elevation. Steam generator 1 is of a conventional design with regard to the fluid circuits. Feedwater at the working pressure of the boiler enters the unit through conduit 2. For industrial service, low temperature economizer 3 is provided which lowers gas temperatures in duct 4 consistent with standard boiler practice for discharge to dust collector 5, I.D. fan 6 and stack 7 which exhausts to atmosphere. For utility service, where extensive regenerative feedwater heating is incorporated in the turbine cycle, air heater 8 would replace low temperature economizer 3 in the gas path. The alternative arrangements are shown on FIG. 1.

In the case where air heater 8 is used, conduit 2 would connect directly to conduit 9. Conduit 9 feeds to economizer 10 which lowers exit gas temperature in duct 11 to a range of 650F.

Effluent from economizer 10 passes through conduit 12 to drum 13 from whence it passes through conduits 14, 15, 16, 17 and 18 to lower waterwall headers which supply the furnace and convection pass waterwalls 19 and 20 respectively. The waterwalls, including side walls, are of the membrane type. After convection type heat transfer from the gas path, waterwalls 19 and 20 discharge to drum 13. The rear furnace wall 19 is connected to drum 13 through conduit 21.

Baffle 22 within drum 13 directs the steam and water mixture to separators 23. Separated water exiting from the bottom of separators 23 joins with feedwater from conduit 12 and is recirculated downward through conduit 14. Separated steam passes through the top of separators 23 through baffles and up through outlet screens 24 to conduit 25.

Conduit 25 connects to primary superheater 26 and through conduit 27 to secondary superheater 28 from whence it flows out through conduit 29 to a steam consumer (not shown).

Water level WL in drum 13 is maintained at a fixed set point by control of feedwater flow through conduit 2 (not shown). Such type of control is known and is standard practice. Metered flow is controlled to a demand set point to anticipate changes in WL during load changes. WL is the final trim for the control.

Combustor 30 is of a modified cyclonic type.

F.D. fan 31 takes air from atmosphere through inlet vanes 32 which control air flow by power actuated means which open and close the vanes in response to a control signal demand. F.D. fan 31 discharges through duct 33 and shutoff damper 34 (for isolation purposes) to air heater 8 (where included) or direct to plenum chamber 35. Fan 31 may be motor or turbine driven (not shown).

Plenum chamber 35 feeds air to combustor 30 through registers 144 in the floor of combustor 30 as is shown. The flow through 144 registers is directed into combustor 30 to create a swirling flow along the walls of combustor 30 through centrifugal action.

Primary fuels, as coal, are fed to combustor 30 through conduit 36. Where $SO_2$ removal is required, limestone is injected with the fuel through conduit 36. Flow control means 87 regulates rate of flow through conduit 36. Fuels as coal and limestone are stored upstream of flow control means 87 and mixing of the two is not part of this invention. When firing oil in combustor 30, limestone may be fed individually through conduit 36. Secondary fuels as trash and waste products enter combustor 30 through conduits 37 and 38. Flow control means 88 is located in conduit 37.

Ignition begins in the lower portion of combustor 30 and as the swirling particles rise in the bed through displacement from fuel and limestone feed and particulate recirculation, they reach the level at which ports 39 are located. Ports 39 supply secondary gas flow which generates sufficiently high gas velocities at this point to entrain desired quantities of bed solids in the gas flow, carrying such solids upward into furnace 40.

The density of the bed in furnace 40 decreases as penetration into the downstream gas path increases. The particulate velocities also increase with penetration due to diminuation in size. There is a velocity increase after the gas enters surface 26, 28, 41, 42 and 10 in series. A gas velocity decrease occurs at the exit of the tube banks.

Surface 41 and 42 can be reheating surface or an extension of or an alternative for superheating or economizer surface.

Reaction or fuel burnup could extend upward into the initial tube banks 26, 28 and 41 as required for heat transfer balance. It is the intent to cool the gas in sections 42 and 10 or earlier in 41 and 28 from a level of 1550F in furnace 40 to a level of 650F in gas duct 11 at economizer 10 outlet.

Spacing of platens 26, 28 and 41 take into account volumetric decreases as gas temperature decreases so as to sustain desired particulate entrainment gas velocity to the outlet of surface 41 at the top of the vertical column.

The volumetric relationship of plenums 43 and 44 is such to permit the gas velocity to drop below entrainment levels at the outlet of platens 41 to permit settlement of the more dense pieces which, when fluidized, will overflow and fall downward along the rear of rear furnace wall 19 to the plenum in gas duct 11. There is sufficient space between platens 42 and 10 and rear wall 19 to permit passage of separated particulates.

Gas passes from plenum 43 to plenum 44 through rear furnace wall tubes 19 at which point the membrane is lacking and alternating tubes have been spread sufficiently to permit the free passage of gas. The slight obstruction creates uniform flow across the vertical tubular cross section which assists in particulate separation from the gas stream.

In cases where particulate separation from the gas stream can be expected above tube banks 26 and 28, bypass ports 45 can be built into rear furnace wall 19 to permit spillover of particulate into down flow section from plenum 44 to duct 11. Such flow would follow the rear furnace wall 19 to plenum 11.

Particulate collected from the rear furnace wall 19 in plenum 11 falls to hopper 47 adjacent to hopper 48 at the outlet of multiclone dust collector 46. Rotary feeder 49 is power driven and feeds dust from hopper 47 to hopper 48 and is provided with a displacement type seal which prevents gas from bypassing the multicyclones.

Each multicyclone is provided with an inlet tube 50. A gas exhaust tube 51 extends part way into inlet tube 50. Vanes are installed between tubes 50 and 51 to spin the gas and dust as it flows downward through the tube 50. The particulate follows the wall of tube 50 and discharges to hopper 48. The clean gas turns upward and flows up through tube 51 to plenum 4 from whence it passes through ducting to economizer surface 3 or air heater 8.

Air heater 8 is provided with tube sheets 52 in which tubes 53 are mounted. The gas from duct 4 passes through tubes 53 to duct 54. F.D. fan 31 discharge air flow passes around tubes 53 in cases where air heater 8 is installed. Gas duct 54 passes to bag house 5 where dust collection is completed. Dust separated in the bags is removed through conduits 55.

Bag house 5 discharges through duct 56 to I.D. fan 6 and duct 57 to stack 7 and from thence to atmosphere. Dampers 58 and 59 are for isolation purposes and to regulate flow of gas so as to maintain a slightly negative pressure in furnace 40.

Gas from plenum 4 is drawn through conduit 60 to gas recirculation fan 61 which can be motor or turbine driven. Dampers 62 and 64 are for isolation purposes. Damper 63 is for flow control. Gas recirculation fan 61 discharges through duct 65 to secondary gas ports 39 for developing particulate entrainment gas velocities in furnace 40.

Secondary air fan 66 takes air from atmosphere through inlet vanes 67 and discharges through duct 68 to duct 65 supplementing gas recirculation flow when additional air flow is required forcombustion purposes. This permits air to be fed both under and over the point of fuel injection into combustor 30. In such manner ignition characteristics in combustor 30 can be controlled.

Particulate collected in hopper 48 passes through loop seal 69. Dust flow through the loop seal is facilitated by means of an air lift. Air under pressure enters through conduit 70 and flow is controlled by regulation means 71 which is power operated.

The recirculation loop of the circulating fluidized bed combustion system can be described as follows. The start of the loop is combustor 30, the point of highest pressure. The combustor 30 is not subject to entrainment gas velocities. Rather, it overflows above the secondary gas ports 39 by addition of fuel and limestone through conduit 36 as well as by addition of particulates collected in hopper 48 through conduit 38. Recirculated particulates are fed in a uniform manner along with the fuel. Requirements for ash removal are of a similar nature.

Gas flow through secondary gas ports 39 lifts the bed materials up into the furnace 40 by way of particulate entrainment. Particulates overflow from the vertical up column to the downflow column connecting to plenum 11, through multicyclone separator 46 or rotary feeder 49 to hopper 48, through loop seal and air lift 69 to conduit 38 and back to combustor 30 for recycle.

The ratio of fuel to inert material within the bed should be about the same for both fixed and circulating type fluidized beds. Due to hangup of particulates throughout the recirculating system, a larger quantity of inert material would be required which would be scattered throughout the gas path of the steam generator. A surge capacity at the bottom of hopper 48 permits recirculated particulate to be fed at a constant or controlled rate to combustor 30. This is the feature which permits the circulating fluidized bed design to respond rapidly to load changes. In a fixed bed combustor, inert material in the bed cannot be varied to follow changes in both fuel flow and load.

Buildup of particulate in hopper 48 determines the degree of ash removal required. Ash would normally be removed from the circulating loop through the opening at the bottom of combustor 30 and through conduit 72 which is water cooled. The configuration depicted in FIG. 1 is exaggerated and is overly large in diameter. Ash would be removed on a continuous basis to maintain equilibrium in the combustion system. Removal of ash must be coordinated with recirculated particulate feed to combustor 30 and rate of firing as measured by coal feed and steam flow.

In cases where the user wishes to burn trash injected into combustor 30 through conduit 37 and 38, provision must be made for removal of nails as from wood pallets or pieces of bailing bands. The rotary movement in combustor 30 causes the pieces of fuel and particulate to follow the walls for ignition and initial burnup, so that the drag associated with metalic trash causes such material to flow toward the center point for removal.

The ash removal conduit 72 is provided with an internal lance 73 which is power actuated by means 74. Actuator 74 is water cooled or otherwise shielded from hot ash and gases. The lance 73 is provided with cover 89 at combustor 30 end and holes in cover 89 permit normal flow of ash to plenum 75. Ash is removed from plenum 75 by means of a vacuum system (not shown) through conduit 76. Periodically, to clean out trash, lance 73 can be injected into combustor 30 and dropped back to pull out a slug of bottoms which fall through gates 77 to hopper 78 below where they can be removed (means not shown). Screens 79 protect plenum 75 from large pieces of debris. Cover 89 can yield or flip in an upward direction to prevent crushing of the combustor 30 floor in the event of large pieces hanging up in the opening. After the slug removal event, care should be taken to stabilize balance of fuel and inert material within the combustor.

Fluidizing air can be admitted through conduit 80 to assist in the removal of fine ash through conduit 76. Pressures in plenum 75 and 78 are controlled to equalize their pressures with that in combustor 30.

Oil or gas fuel can be admitted through conduit 81, flow control means 82 and nozzles 83 into combustor 30 for firing during unit startup or for use as a supplemental or emergency fuel during times when the design fuel supply means has been interrupted. Nozzles 83 are equipped with ignition means.

The basic fundamental associated with fluidized bed combustion is that fuel is fired in close association with inert particulate so that the radiant aspects of combustion are eliminated from the process.

Combustion takes place at a lower temperature and when controlled in a 1550F range, reaction with limestone for $SO_2$ removal is maximized. Combustion rate can be controlled by both fuel flow and availability of oxygen. Availability of oxygen is over-riding and limiting.

The advantages of being able to extend the bed height upward into furnace 40 become obvious. Practically all heat transfer in steam generator 1 is of the convection type. The heat exchange surface transfer rates are greatest when they are immersed within the fluidized combustion process. It is less expensive to build a tall vertical furnace with relatively small horizontal cross section area for a circulating bed design compared with a low head, large horizontal cross section area for a fixed bed unit of equivalent capacity. In the case of a tall furnace, there is more square feet of wall surface per cubic foot of fluidized bed volume.

Particulate density is greatest in the lower zone of the furnace. Furnace walls have shown little sensitivity to erosion for the recirculating bed design. Thus, where platens 26, 28 and 41 are located in the less dense particulate zone, minimum tube erosion can be expected.

The combustion process takes place at temperatures which are substantially below ash softening and deformation levels. Thus, the ash never has an opportunity to melt or become sticky. It can be compared to ash which is produced in a charcoal grill. The particulates will flow readily over the heat exchange platens much in the nature of what happens in the case of a fluid. Abrasive particles tend to be minimal.

Control considerations are as follows:

Drum water level WL control is conventional and water is supplied at a rate consistent with load and volumetric changes within the generating circuits to hold water level WL essentially constant. Such type of control is a stand alone item.

Steam pressure at the superheater outlet is maintained constant or to any characterized variable set point by control of firing rate including fuel and air flow.

Steam temperature is controlled by means of spray water injection between the primary and secondary superheater at point 90. Spray water is taken at a point downstream of the economizer and bypasses the evaporating and primary superheater circuits. It has the effect of biasing the heat absorption ratio required of the steam generating and superheating circuits. Gas recirculation is a means or restoring spray water quantity to a neutral value over the load range. The effects would be different for each type of heat absorption configuration and would be a tool used by the boiler designer to achieve balances over the load range. Gas recirculation would be an effective tool in balancing superheat and reheat steam temperatures. There are limits to the use of gas recirculation as a result of gas velocities required for particulate entrainment in the gas stream. Bypass dampers could also be used to bias main and reheat steam temperatures. A different surface and baffle configuration would be required.

Furnace temperature is controlled by adjustment of the ratio of fuel to recirculated particulate fed to combustor 30. The loop seal air lift 69 is capable of precise control of mass flow to combustor 30 through regulatory means 71 which, through characterization, adjusts air flow to the air lift to change particulate flow proportionally to changes in the demand input signal to means 71.

Plenum 11 gas temperature is controlled by means of gas recirculation and air flow through secondary gas ports 39 and as metered by flow meters 85 and 86. As temperatures rise in plenum 11, gas recirculation flow is diminished and vice versa. Set point temperature for plenum 11 will vary over the load range and is optimized after observations of actual performance of the unit. Variation of gas velocities at the inlet end of the furnace 40 in the entrainment range will control the classification range of particulates which recirculate.

Excess air would be controlled as appropriate for the fuel to be fired. Excess air accomodates unbalances in fuel loading throughout the gas stream. In spite of the presence of some excess air, air flow becomes limiting since the fuel actually does not have access to all air available. Excess air would be controlled by biasing air flow to gas recirculation flow in controlling $O_2$ to a preset value for a definitive gas mass flow.

Since ash removal impacts upon recirculated particulates to some extent, its removal should be coordinated with feed of particulate to combustor 30 from hopper 48 for recirculation.

FIG. 2 is a diagram of the basic control system. Drum level and steam temperature controls are standard and have not been illustrated. All control elements are connected with conduit means as indicated.

Demand for steam flow is set in control unit 91. The output of unit 91 is corrected for steam pressure error in ratio unit 92. Unit 94 transmits steam pressure at point 93 (FIG. 1) to difference unit 95 where pressure is compared with set point setter 96 output. The error from unit 95 is transmitted to proportional, integral, derivative (PID) unit 97 which provides ratio correction in unit 92. The corrected demand signal feeds to characterizing function generators 98, 99, 100, 101, 102 and 103.

Unit 98 establishes set point for oxygen in the flue gas. Transmitter 105 sends measurement of oxygen at point 104 (FIG. 1) to difference unit 106. The error is transmitted to PID unit 107. The output of 107 is high/low limited by unit 108. Oxygen correction of air flow demand is performed in ratio unit 109.

Unit 109 output is characterized in function generator 110 which provides a set point for actual air flows measured by meters 84 and 86 (FIG. 1) and transmitted by units 111 and 112 to summer 113. The sum is compared with set point in unit 114 and the error sent to PID unit 115 which sends a corrected demand for air flow to characterizing function generators 116 and 117 which actuate F.D. fan 31 inlet vane 32 controller 118 and secondary air fan 66 inlet vane 67 controller 119. Operation of the fans would be of a sequential nature.

Fuel flow demand is characterized in unit 103 and is compared with actual fuel flow measured by gravimetric means upstream of conduit 36 (FIG. 1) and transmitted by unit 120 to difference unit 121. The error is sent to PID unit 122 and the corrected demand is transmitted to characterizing unit 123 and controller 124 which positions fuel feed flow control means 87 (FIG. 1).

Temperature as measured in duct 11 at point 125 (FIG. 1) is transmitted by unit 126 to difference unit 127 where it is compared with a characterized set point from unit 99. The error is sent to PID controller 128. The corrective action from unit 128 is low limited in unit 129 which receives a set point from unit 100 for minimum gas recirculation flow for particulate entrainment purposes. The demand for total air and gas recirculation flow is compared with actual flow in difference unit 130. Gas recirculation flow as measured by meter 85 (FIG. 1) is transmitted by unit 131 and summed with total air flow in unit 132. The unit 130 error is sent to PID controller 133. The corrected output is characterized in 134 and sent to control unit 135 which positions gas recirculation fan 61 flow control dampers 63 (FIG. 1).

Furnace temperature measured at point 136 (FIG. 1) is transmitted by unit 137 to difference unit 138 and compared with unit 101 set point. The error is sent to PID unit 139. The corrected signal is high/low limited in 140 and is combined with a characterized value in summer 141. Limiter 140 assures dangerous limits are not exceeded. The direct signal from 102 assures a minimum flow of recirculated particulate. The output from summer 141 is characterized in 142 and sent to controller 143 which positions flow control means 71 (FIG. 1) for controlling recirculated particulate flow.

Thus, it will be seen that I have provided an efficient embodiment of my invention, whereby a means is provided to control penetration of the fuel ignition and reaction zone into the downstream portion of the recirculating fluidized bed loop starting from the high pressure location. A means is provided to maintain the head end of the loop at a uniform temperature with temperature decay occurring progressively at the tail end of the loop. Gas recirculation is utilized to attain gas velocities for entrainment of particulates. Entrainment velocities can be maintained independently of air flow. Particulate separation by gravity can be achieved in the downstream portion of the circulating loop. A unitized steam generator structure has been developed and debris may be conveniently removed from the base of the combustor.

While I have illustrated and described several embodiments of my invention, it will be understood that these are by way of illustration only and that various changes and modifications may be made within the contemplation of my invention and within the scope of the following claims:

I claim:

1. A steam generator having a feedwater inlet and steam outlet and coolant filled heat absorption circuits disposed in between, a vertical up flow furnace, walls for said furnace including a first portion of said heat absorption circuits, a combustion system contained by said furnace comprising a first ignition and reaction zone at the bottom of said furnace, means for continuously feeding solid fuel and air to said first zone sustaining combustion and generating hot flue gas, a second zone above said bottom of said furnace including means for admission of secondary gas to said furnace, means for overflowing said hot flue gas and said solid fuel from said first zone along with recycled solids up into said second zone to form a combined gas stream, means to maintain velocity of the combined gas stream in and above said second zone sufficient for entraining in said combined gas stream a substantial portion of said overflowed solid fuel and recycled solids, additional portions of said heat absorption circuits disposed horizontally at the outlet of said furnace and provided with an enclosure interconnected with said furnace walls, means causing the volumetric relationship of said enclosure and gas temperature to drop across components of said additional portions for reducing velocity of said combined gas stream between said components below entrainment level for part of said entrained solids permitting said solids part to settle in a fluidized state, means for separation of said solids remaining in said main path of said combined gas stream at a downstream location, means for continuously draining said settled solids port away from the main path of said combined gas stream, means to recycle said drained away settled solids part and said separated remaining solids between said first and second zones, and means to exhaust said main path of said combined gas stream after said remaining solids separation.

2. A steam generator as recited in claim 1 and including means for individual control of mass flow rate of said recycled solids and said solid fuel and said air and said secondary gas to said furnace in proportions to maintain a relatively constant medium furnace gas temperature and a substantially lower gas temperature at said point of separation of said remaining solids.

3. A steam generator as recited in claim 1 and wherein at least a first portion of said secondary gas comprises air, including a fan or blower adapted to deliver said air to said secondary gas admission means.

4. A steam generator as recited in claim 1, said interconnected enclosure for said additional portions of said heat absorption circuits and said related combined gas stream being configured as an inverted U, said combined gas stream entering said interconnected enclosure in an upflow direction and passing through a first part of said additional portions of said heat absorption circuits, said combined gas stream then reversing direction in a U path and flowing downward through the remaining part of said additional portions of said heat absorption circuits, conduit means for flowing any of said settled solid portion in said upflow combined gas stream to a lower level in said downflow combined gas stream.

5. A steam generator as recited in claim 2 and wherein a second portion of said secondary gas comprises a portion of said combined gas after separation of said remaining solids, including a fan or blower adapted to recirculate said portion of said combined gas after separation of said remaining solids to said secondary gas admission means, and means to vary the proportions of said air and said recirculated combined gas supplied to said secondary gas admission means.

6. A steam generator having a feedwater inlet and steam outlet and coolant filled heat absorption circuits disposed in between, a furnace, an enclosure for said furnace at least partially cooled by a portion of said heat absorption circuits and adapted to contain a combustion system comprising a first ignition and reaction zone at the bottom, means for feeding solid fuel and air continuously to said first zone individually and at controlled flow rates to sustain combustion and to generate hot flue gas, a second zone including means for admission of secondary gas above said bottom of said furnace at a controlled flow rate, said hot flue gas and said solid fuel material overflowing from said first zone along with recycled solids up into said second zone to form a combined gas stream, said flue gas and said secondary gas maintaining downstream combined gas velocity sufficient to entrain at least a significant portion of said fuel and said recycled solids in said combined gas stream, additional portions of said coolant heat absorption circuits disposed at the outlet of said furnace, an extension of said furnace enclosure for housing said additional portions, means for separating said solids entrained in said downstream combined gas stream intermediately and/or at the outlet of said additional portions of said heat absorption circuits, means for collecting and recycling said separated solid particles to said second zone combined gas stream at a controlled flow rate and to increase said flow rate of said separated particles in response to high temperature of said furnace combined gas and vice versa, said means for feeding air and said means for admitting secondary gas to said furnace to increase said downstream combined gas flow rate in response to low temperature of said combined gas at a point intermediately or at the outlet of said additional portions and vice versa, said additional portions of said heat absorption circuits and mass flow rates of said entrained solid particles and said downstream combined gas being proportioned to maintain said second zone furnace gas temperature at a medium level as 1550F while maintaining said combined gas temperature at said outlet of said additional portions at a substantially lower level as 650F.

7. A steam generator as recited in claim 6 and wherein at least a first portion of said secondary gas comprises air, including a fan or blower adapted to deliver said air to said secondary gas admission means.

8. A steam generator as recited in claim 7 and wherein a second portion of said secondary gas comprises a portion of said combined gas after separation of said solids, including a fan or blower to recirculate said combined gas portion after solids separation to said gas admission means, and means to vary the proportions of said air and said recirculated combined gas supplied to said secondary gas admission means responsive to excess air measurement in said combined gas stream at a downstream location.

* * * * *